US011759908B2

(12) United States Patent
Sun

(10) Patent No.: US 11,759,908 B2
(45) Date of Patent: Sep. 19, 2023

(54) HANDHELD BELT SANDER WITH IMPROVED STRUCTURE

(71) Applicant: STORM PNEUMATIC TOOL CO., LTD., Taichung (TW)

(72) Inventor: Yung Yung Sun, Taichung (TW)

(73) Assignee: STORM PNEUMATIC TOOL CO., LTD., Taichung (TW)

( * ) Notice: Subject to any disclaimer, the term of this patent is extended or adjusted under 35 U.S.C. 154(b) by 438 days.

(21) Appl. No.: 17/094,455

(22) Filed: Nov. 10, 2020

(65) Prior Publication Data

US 2021/0146498 A1 May 20, 2021

(30) Foreign Application Priority Data

Nov. 15, 2019 (TW) ..... 108215141

(51) Int. Cl.
*B24B 23/06* (2006.01)

(52) U.S. Cl.
CPC ..... *B24B 23/06* (2013.01)

(58) Field of Classification Search
CPC ..... B24B 23/06; B24B 55/057; B24B 21/006; B24B 21/16; B24B 21/165; B24B 21/18; B24B 21/002; B24B 21/20; B24B 21/12; B24B 21/14; F16H 7/18; F16H 7/20; B65G 23/44; B65H 23/16; B65H 23/26
USPC ..... 474/144; 451/259, 264, 296, 334, 336, 451/355; 198/813, 816
See application file for complete search history.

(56) References Cited

U.S. PATENT DOCUMENTS

| | | | | | |
|---|---|---|---|---|---|
| 1,599,666 | A * | 9/1926 | Manley | B66D 3/06 | 254/395 |
| 5,168,658 | A * | 12/1992 | Price | B24B 23/02 | 451/512 |
| 5,341,605 | A * | 8/1994 | Tasikas | B24B 7/188 | 451/461 |
| 7,097,547 | B2 * | 8/2006 | McCroary | B24B 21/20 | 451/296 |
| 2021/0088120 | A1 * | 3/2021 | Williams | F16H 55/36 | |

FOREIGN PATENT DOCUMENTS

| | | | | |
|---|---|---|---|---|
| CN | 112871535 | A * | 6/2021 | B05B 13/0221 |
| JP | 2004001102 | A * | 1/2004 | |
| KR | 101310837 | B1 * | 10/2013 | |
| TW | M519031 | U | 3/2016 | |

* cited by examiner

*Primary Examiner* — Joel D Crandall
*Assistant Examiner* — Sharonda T Felton
(74) *Attorney, Agent, or Firm* — Muncy, Geissler, Olds & Lowe, P.C.

(57) ABSTRACT

A handheld belt sander with improved structure includes a main body having a rotating wheel and a mount. A support rod with a front roller is disposed on the mount. A support member with a rear roller is disposed on the mount. A tightened grinding belt encircles the rotating wheel, the front roller and the rear roller. A space is formed between the support rod and a part of the grinding belt between the front roller and the rear roller so that the grinding belt moves into the space after being pressed. Two side rollers are disposed on two sides of the support member to be adjacent to the grinding belt and are separated from the grinding belt by a gap in order to block the grinding belt from separating from the rear roller.

4 Claims, 6 Drawing Sheets

HANDHELD BELT SANDER WITH IMPROVED STRUCTURE

FIELD OF THE INVENTION

The present invention relates to a hand tool for grinding, and more particularly to a handheld belt sander.

BACKGROUND OF THE INVENTION

A conventional belt sander has a handle and a rotating wheel driven by a motor. A support rod is disposed on a main body. A grinding belt encircles the support rod and the rotating wheel and is driven by the rotating wheel functioned by the motor to grind a surface of an object. However, the support rod extends forwardly from the main body in a straight direction, tightening the grinding belt to be very close to the support rod. Being stopped by the support rod, the grinding belt is not able to move to an appropriate position to fit an arc surface of the object. Then the arc shape of the ground surface may be damaged.

A conventional belt sander, such as that disclosed in TW Patent No. M519031, includes an adjustable rod pivotally connected with a support rod. A grinding belt is able to be pushed away from the support rod when the adjustable rod is pivotally moved relative to the support rod so as to form a space between the two rods and the grinding belt to be entered by the pressed grinding belt. Accordingly, an arc surface of an object may be ground well.

However, position of the adjustable rod must be firstly adjusted before grinding, which is not convenient to use because of time wasting. Besides, user must twist his wrist to make the grinding belt engage with the ground surface completely as a result of the adjustment to the adjustable rod executed at a terminal end of the support rod. User's wrist may feel unwell after a long time use. Furthermore, the grinding belt, during work, is pressed to move laterally so that the high-speed grinding belt may separate from the roller and fly out to hurt the user.

SUMMARY OF THE INVENTION

The primary object of the present invention is to provide a handheld belt sander having a space formed between a grinding belt and a support rod to be entered by the pressed grinding belt. It is suitable to grind arc surfaces of objects and keeps a good hand posture to avoid damages. Additionally, the grinding belt can be blocked from moving laterally to separate from the rollers, and therefore user is protected.

In order to achieve the above object, a handheld belt sander is provided. The handheld belt sander includes a main body, a mount, a support member, a grinding belt and two side members. The main body has a motor connected with a rotating wheel. The mount is disposed at a fore end of the main body and is provided with a straight support rod extending along a first direction. A front roller is disposed on the support rod. The support member is disposed on the mount and extending along a second direction. The support member is provided with a rear roller having a wheel portion with an inner room, the inner room being enclosed with a dust-proof cover and accommodating two bearings separated by a spacer. A shaft fixed to the support member penetrates through the bearings, the spacer and the dust-proof cover. Each of the bearings, the spacer and the dust-proof cover has an annular axially protruding portion disposed at a side close to the shaft to abut each other so as to keep the bearings apart from the spacer and the dust-proof cover at a side far from the shaft. The grinding belt encircles the rotating wheel, the front roller and the rear roller. A space is formed between the support rod and a part of the grinding belt between the front roller and the rear roller so that the grinding belt moves into the space when pressed. The two side members are disposed on two sides of the support member. Each of the side members is provided with a column extending along the second direction. Each of the columns is rotatably connected with a side roller in alignment with the rear roller in the second direction. Each of the side rollers is located adjacent to the grinding belt and is separated from the grinding belt by a gap in order to block the grinding belt from separating from the rear roller when moving laterally. A position of a bottom portion of the rear roller is located between a top end and a bottom end of the side rollers.

Preferably, each of the side rollers is positioned on an end portion with a diameter greater than that of the column.

Preferably, each of the columns is fixed to the corresponding side member by threads.

Preferably, the mount has a notch portion with at least two positioning surfaces to be inserted by the support member, the support member abutting against the positioning surfaces for positioning.

Preferably, the first direction is perpendicular to the second direction.

DETAILED DESCRIPTION OF THE PREFERRED EMBODIMENTS

Figure 1:
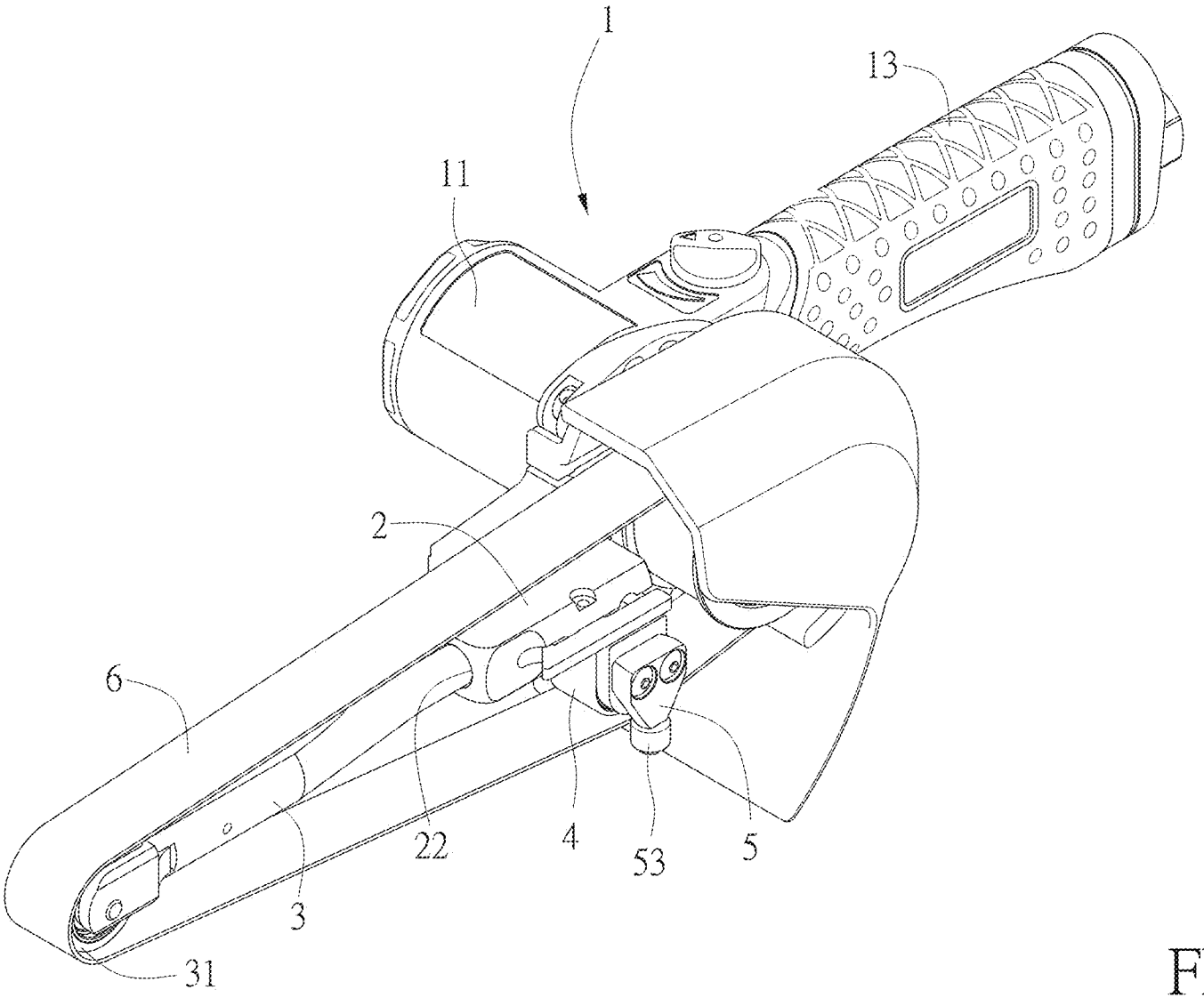
FIG. 1 is a perspective view of the present invention.

Referring to FIG. 1 to FIG. 4, a handheld belt sander of the present invention includes a main body 1 having a fore end and a rear end. A motor 11 is disposed on the main body 1 and connects with a rotating wheel 12 driven by the motor 11. A handle 13 for a purpose of holding is integrally formed at the rear end of the main body 1. A mount 2 is disposed at the fore end of the main body 1. A hole 22 is provided on the mount 2 to be inserted with a straight support rod 3 with no bend which extends along a first direction D1. The support rod 3 extends out of the hole 22 and is provided with a front roller 31 at a terminal.

Figure 4:
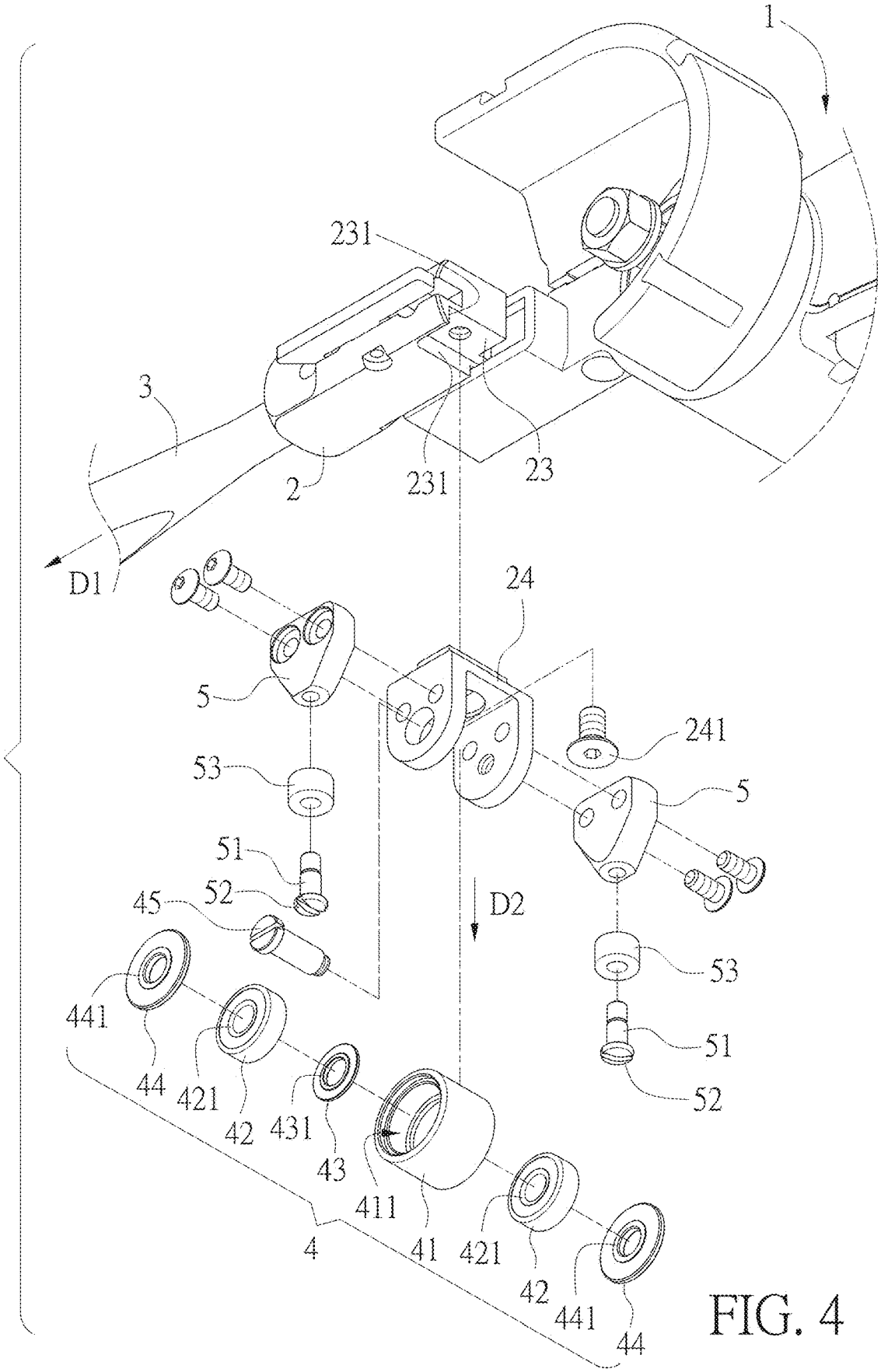

A notch 23, as shown in FIG. 4, is disposed on a bottom of the mount 2. A support member 24 is inserted into the notch 23 and is fixed with a screw 241. The support member 24 extends along a second straight direction D2 which is perpendicular to the first direction D1. In this embodiment, the notch 23 has two positioning surfaces 231 to be abutted against by the support member 24 in order to keep position.

Figure 5:
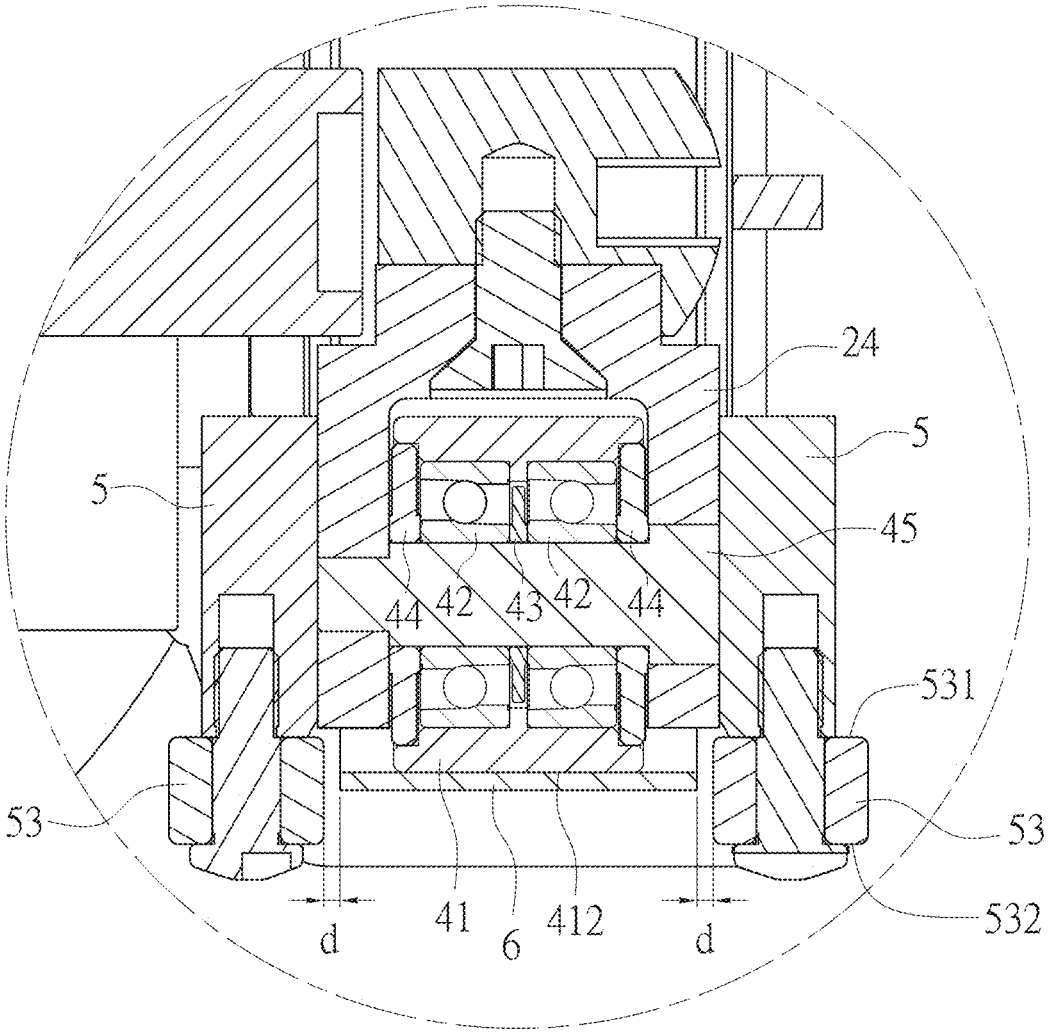
FIG. 5 is a sectional view of a part of the present invention.

As shown in FIG. 4 and FIG. 5, a rear roller 4 is rotatably connected to the support member 24. The rear roller 4 includes a wheel portion 41 having an inner room 411 with two openings. Two bearings 42 separated by a spacer 43 are accommodated in the inner room 411. Each of the openings is sealed by a dust-proof cover 44. A shaft 45 fixed to the support member 24 penetrates through the bearings 42, the spacer 43 and the dust-proof cover 44. Each of the bearings 42, the spacer 43 and the dust-proof cover 44 has an annular axially protruding portion 421, 431, 441 disposed at a side close to the shaft. The annular axially protruding portion 421 abuts against the annular axially protruding portion 431 between the bearing 42 and the spacer 43 while the annular axially protruding portion 421 abuts against the annular axially protruding portion 441 between the bearing 42 and the dust-proof cover 44. Thus the bearings 42 are kept apart from the spacer 43 and the dust-proof cover 44 at a side far from the shaft 45 so as to rotate smoothly. Rotation of the wheel portion 41 is also improved.

Figure 2:
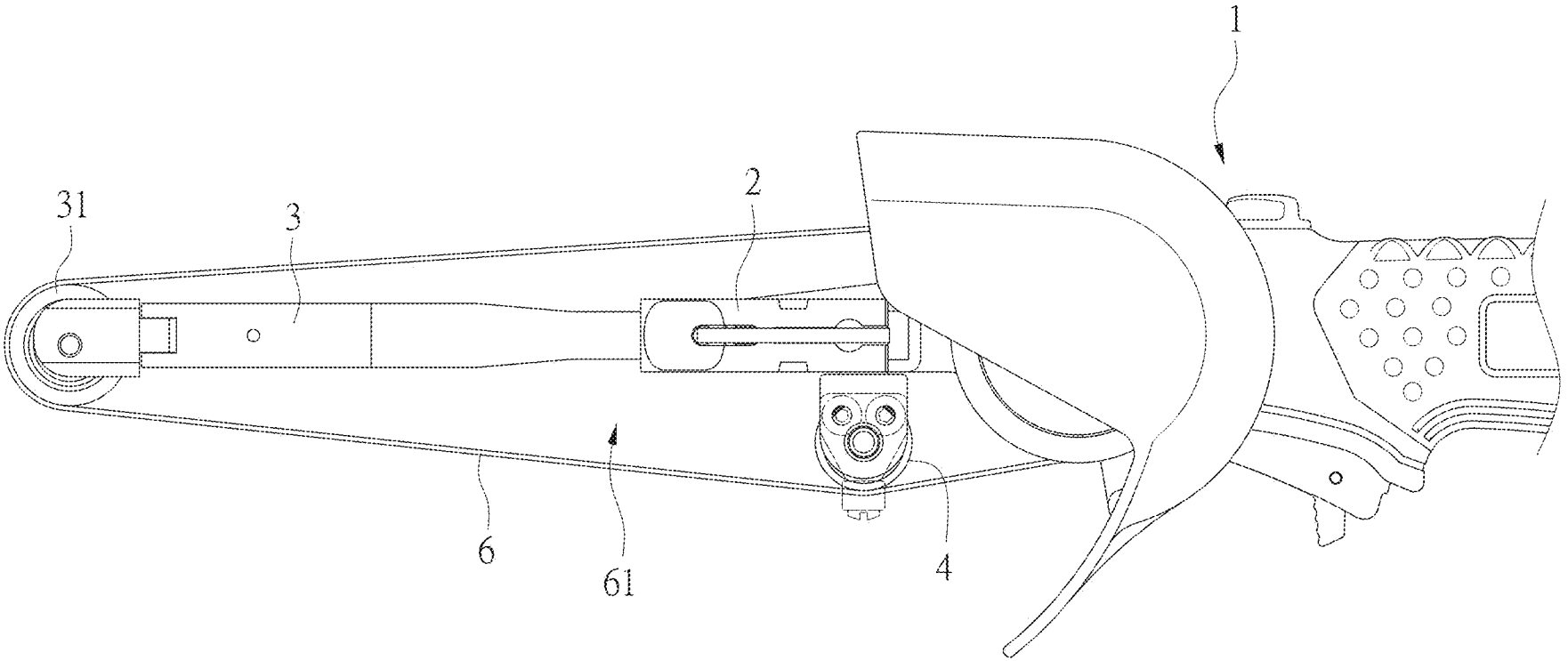
FIG. 2 is a schematic view of the present invention.
Figure 3:
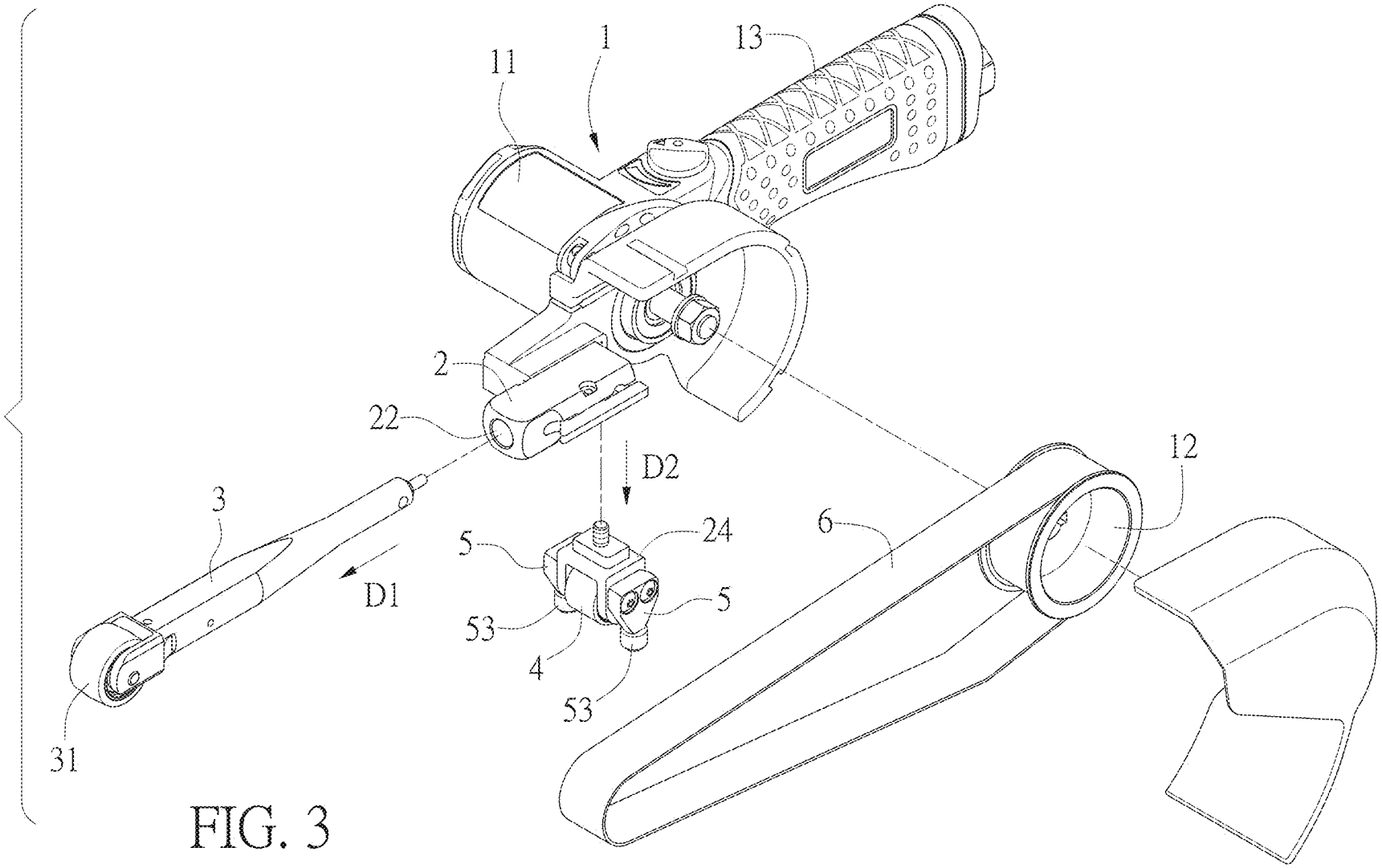
FIG. 3 and FIG. 4 are exploded views of the present invention.

A grinding belt 6, as shown in FIG. 2 and FIG. 3, encircles the rotating wheel 12, the front roller 31 and the rear roller 4 and is tightened. A triangle space 61 is formed between the support rod 3 and a part of the grinding belt 6 between the front roller 31 and the rear roller 4 as a result of orientations of the front roller 31 and the rear roller 4. When the grinding belt 6 is pressed, it changes to curve and move into the space 61.

Referring to FIG. 3 and FIG. 4, two side members 5 are respectively disposed on two sides of the support member 24. Each of the side members 5 is firmly connected with a column 51 by threads. Each of the columns 51 extends along the second direction D2 and has an end portion 52 with a diameter greater than that of the column 51. Each of the columns 51 is rotatably connected with a side roller 53 in alignment with the rear roller 4 in the second direction D2. Each of the side rollers 53 abuts against the end portion 52 of corresponding column 51 for positioning. As shown in FIG. 5, two said side rollers 53 are respectively located adjacent to the grinding belt 6 and separated from the grinding belt 6 by a gap d. Although the side rollers 53 are not in direct contact with the grinding belt 6, the side rollers 53 still can block the grinding belt 6 from separating from the rear roller 4 when moving laterally. Furthermore, a position of a bottom portion 412 of the rear roller 4, or the lowest position of the wheel portion 41, is located between a top end 531 and a bottom end 532 of the side rollers 53 to ensure that position of the grinding belt 6 is set between the top end 531 and the bottom end 532 of the side rollers 53.

Figure 6:
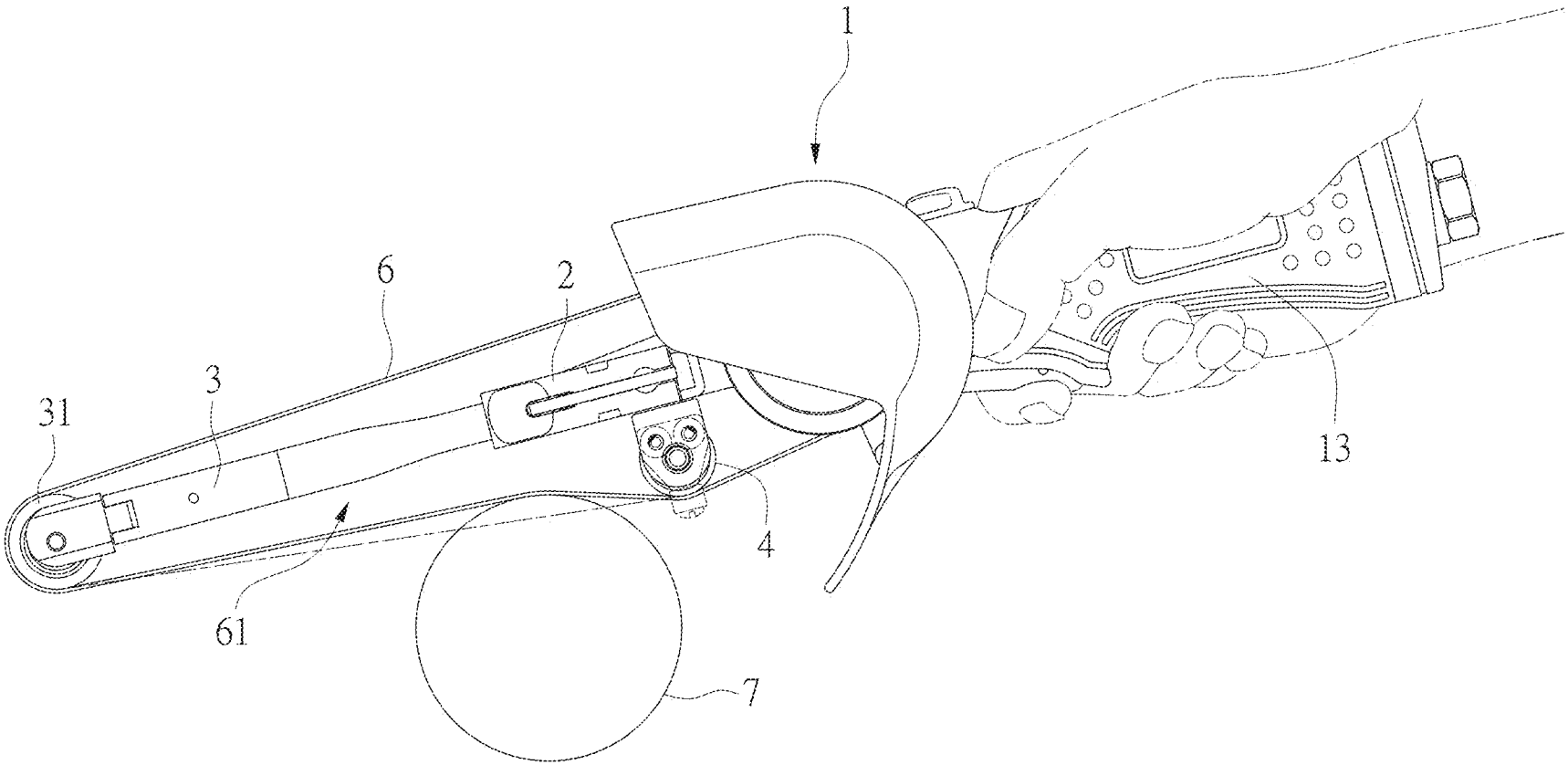
FIG. 6 is a schematic view of the present invention when in use.

Referring to FIG. 6, when using the belt sander to grind on an arc surface 7 of an object, the grinding belt 6 is pressed by the object to curve and thus enters the space 61. According to this, the grinding belt 6 can be curved in an appropriate way by the operating force from user so as to ensure the arc surface 7 from being over-ground.

Moreover, in course of using the belt sander, user can hold the handle 13 in a natural wrist posture due to the support member 24 where the rear roller 4 is set on the mount 2, or the support member 24 is set close to the handle 13, so that user's wrist is not twisted to get hurt.

Owing to the improvement to the rear roller 4 for smooth rotating, the grinding belt 6 can rotate forward stably and not move laterally to separate from the rear roller 4. The grinding belt 6 may be pushed by the contact with the object to move laterally, but the moving grinding belt 6 will be blocked by the side rollers 53 from separating from the rear roller 4, avoiding user from damage.

What is claimed is:

1. A handheld belt sander comprising:

a main body having a motor connected with a rotating wheel; a handle formed at a rear end of the main body;

a mount disposed at a fore end of the main body, the mount being provided with a straight support rod extending along a first direction, wherein a front roller is disposed at an end of the support rod;

a support member disposed on the mount and extending along a second direction, the support member being provided with a rear roller having a wheel portion with an inner room, the inner room being enclosed with a cover and accommodating two bearings separated by a spacer, the bearings, the spacer and the cover being penetrated by a shaft fixed to the support member, wherein each of the bearings, the spacer and the cover has an annular axially protruding portion disposed at a side close to the shaft to abut each other so as to keep the bearings apart from the spacer and the cover at a side far from the shaft;

a tightened grinding belt encircling the rotating wheel, the front roller and the rear roller; a space formed between the support rod and a part of the grinding belt between the front roller and the rear roller so that the grinding belt moves into the space when pressed;

two side members respectively disposed on two sides of the support member, each of the side members being provided with a column extending along the second direction, two said side rollers being located adjacent to the grinding belt and separated from the grinding belt by a gap in order to block the grinding belt from separating from the rear roller when moving laterally, wherein a position of a bottom portion of the rear roller is located between a top end and a bottom end of the side rollers, wherein each of the columns is fixed to the corresponding side member by threads.

2. The handheld belt sander as claimed in claim 1, wherein each of the side rollers is positioned on an end portion with a diameter greater than that of the column.

3. The handheld belt sander as claimed in claim 1, wherein the mount has a notch portion with at least two positioning surfaces to be inserted by the support member, the support member abutting against the positioning surfaces for positioning.

4. The handheld belt sander as claimed in claim 1, wherein the first direction is perpendicular to the second direction.

* * * * *